US009847016B2

(12) United States Patent
McWhirter et al.

(10) Patent No.: US 9,847,016 B2
(45) Date of Patent: Dec. 19, 2017

(54) SYSTEM AND METHOD OF COMMUNICATING DATA FROM AN ALARM SYSTEM TO EMERGENCY SERVICES PERSONNEL

(71) Applicant: Honeywell International Inc., Morristown, NJ (US)

(72) Inventors: Alan Robert McWhirter, Linlithgow (GB); Robert John Probin, Glasgow (GB); Martin Leonard Crisp, Motherwell (GB)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 115 days.

(21) Appl. No.: 14/324,426

(22) Filed: Jul. 7, 2014

(65) Prior Publication Data

US 2016/0005306 A1 Jan. 7, 2016

(51) Int. Cl.

| | |
|---|---|
| ***G08B 1/08*** | (2006.01) |
| ***G08B 25/10*** | (2006.01) |
| ***G08B 13/196*** | (2006.01) |
| *G08B 25/00* | (2006.01) |
| *G08B 25/08* | (2006.01) |

(52) U.S. Cl.

CPC ..... *G08B 25/10* (2013.01); *G08B 13/196* (2013.01); *G08B 25/009* (2013.01); *G08B 25/08* (2013.01)

(58) Field of Classification Search

None

See application file for complete search history.

(56) References Cited

U.S. PATENT DOCUMENTS

| | | | | |
|---|---|---|---|---|
| 2004/0027244 | A9* | 2/2004 | Menard | A61B 5/0002 340/573.1 |
| 2007/0194906 | A1* | 8/2007 | Sink | G08B 17/10 340/506 |
| 2007/0210910 | A1* | 9/2007 | Norstrom | G08B 27/001 340/506 |
| 2008/0122609 | A1* | 5/2008 | Mannisto | G08B 19/005 340/500 |
| 2009/0077167 | A1 | 3/2009 | Baum et al. | |
| 2010/0182984 | A1* | 7/2010 | Herscovici | H04L 63/0892 370/338 |
| 2011/0140882 | A1* | 6/2011 | Jang | G08B 25/009 340/539.13 |
| 2011/0225238 | A1* | 9/2011 | Shaffer | H04L 63/08 709/204 |

(Continued)

OTHER PUBLICATIONS

Extended European search report for corresponding EP patent application 15171444.1, dated Nov. 3, 2015.

(Continued)

*Primary Examiner* — Julie Lieu

(74) *Attorney, Agent, or Firm* — Husch Blackwell LLP

(57) ABSTRACT

Systems and methods of communicating data from an alarm system to emergency services personnel are provided. Some methods can include receiving information from a monitoring system in a monitored region via a first communications link, where the information relates to a detected event in the monitored region. Upon receiving the information, some methods can also include transmitting the information to a communications module via a second, different communications link.

17 Claims, 2 Drawing Sheets

(56) References Cited

U.S. PATENT DOCUMENTS

| | | | | |
|---|---|---|---|---|
| 2013/0057695 | A1 | 3/2013 | Huisking | |
| 2013/0141232 | A1* | 6/2013 | Richman | G08B 13/19608 340/517 |
| 2014/0167954 | A1* | 6/2014 | Johnson | G08B 25/016 340/539.11 |
| 2015/0161864 | A1* | 6/2015 | Richman | G08B 13/19608 340/539.13 |

OTHER PUBLICATIONS

Ying Zhang et al., Bluetooth-Based Sensor Networks for Remotely Monitoring the Physiological Signals of a Patient, IEEE Transactions on Information Technology in Biomedicine, Nov. 30, 2009, pp. 1040-1048, vol. 13, No. 6, Los Alamitos, CA, USA.

* cited by examiner

SYSTEM AND METHOD OF COMMUNICATING DATA FROM AN ALARM SYSTEM TO EMERGENCY SERVICES PERSONNEL

FIELD

The present invention relates generally to alarm systems. More particularly, the present invention relates to a system and method of communicating data from an alarm system to emergency services personnel.

BACKGROUND

When an alarm system detects the occurrence of an alarm or other event, emergency services personnel can be notified and, in some cases, be dispatched to the site of the alarm system. However, often the emergency services personnel, both on and off site, do not have a clear understanding of the circumstances surrounding the detected alarm or other event.

In view of the above, there is a continuing, ongoing need for an improved alarm system.

DETAILED DESCRIPTION

Figure 1:
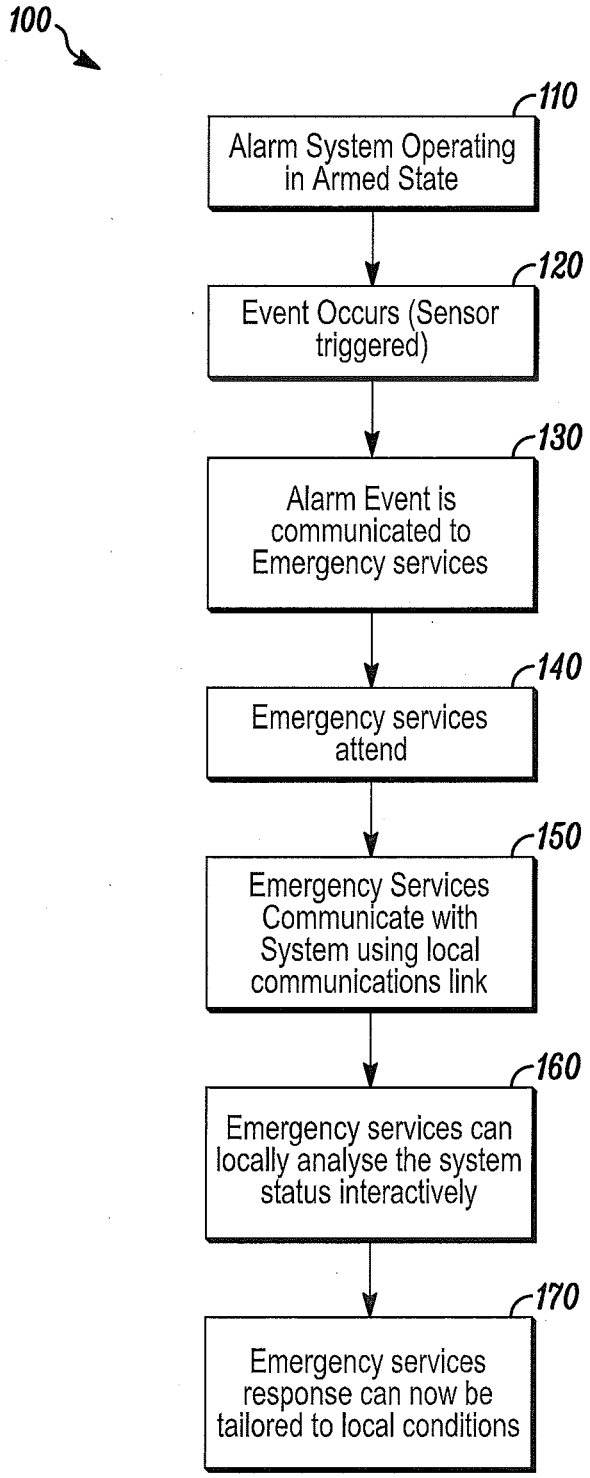
FIG. 1 is a flow diagram of a method in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein include a system and method of communicating data from an alarm system to emergency services personnel. For example, in some embodiments, the alarm system can communicate with on-site and/or off-site emergency services personnel via radio communication. Furthermore, in some embodiments, the alarm system can communicate real-time data to the emergency services personnel.

The alarm system as disclosed herein can monitor a region, for example, a building. When the alarm system detects the occurrence of an alarm or other event, the alarm system can notify the emergency services personnel and, in some cases, the emergency services personnel can be dispatched to the monitored region. In some embodiments, systems and methods disclosed herein can communicate with the emergency services personnel dispatched to the monitored region while the personnel is en route to the monitored region and/or upon arrival at the monitored region, for example, once the emergency services personnel is within a predetermined distance from the monitored region.

In some embodiments, systems and methods disclosed herein can provide the emergency services personnel with information regarding the monitored region and/or the detected alarm or other event. Accordingly, the emergency services personnel can quickly gain an understanding about the circumstances surrounding the detected alarm or other event.

In some embodiments, systems and methods disclosed herein can additionally or alternatively communicate with authorized security guards and/or with authorized private security personnel, any of whom who may or may not be on-site of the monitored region.

Information that can be communicated from the alarm system to the emergency services personnel can include, but is not limited to the location of individuals within the monitored region, floor plans of the monitored region, an identification of doors, windows, or rooms that have been breached or compromised, and information about intruders or other unauthorized individuals in the monitored region, including whether or not they are armed and where, when, and how they gained access to the monitored region. In some embodiments, images and/or live video data streams showing the monitored region can be communicated to the emergency services personnel that include images relevant to the alarm, including images of an intruder, which can be used to identify the intruder.

It is to be understood that, although systems and methods disclosed herein are discussed with respect to alarm systems, systems and methods disclosed herein are not so limited. Instead, systems and methods disclosed herein can be used in connection with any monitoring system, including, but not limited to intrusion alarm systems, ambient condition detection systems, such as gas or fire detection systems, access control systems, video systems, and the like.

In accordance with disclosed embodiments, the alarm system can automatically log all events, for example, alarm or intrusion events that occur in the monitored region. The alarm system can also record and/or store images and/or video data streams associated with the logged events. For example, in some embodiments, the alarm systems can include sensors, such as passive infrared (PIR) motion sensors that, upon detecting a predetermined condition, can activate a data collection device, such as a camera positioned to capture images of the monitored region.

When the alarm system detects the occurrence of the alarm or other event, the alarm system can communicate with the emergency services personnel and transmit relevant portions of the events logged by the alarm system, live and/or stored images, and/or the video data streams captured by the alarm system. In some embodiments, communication between the alarm system and the emergency services personnel can be via a secure, local radio frequency (RF) communications connection, such as a communications connection utilizing Bluetooth or Zigbee. In some embodiments, the communication between the alarm system and the emergency services personnel can be via an alternative communications interface, such as an optical or light interface or an infrared (IR) signaling interface.

In an exemplary embodiment, the alarm system can detect the occurrence of the alarm or other event in the monitored region, and an alarm system control panel can transmit alarm or event information to a local communications device. Then, the emergency services personnel can be authorized or authenticated, either automatically by systems and methods disclosed herein or by a third party, to access and communicate with the local communications device. Upon authorization, the emergency services personnel can connect with the local communications device via, for example, a portable device, such as a smart phone, mobile phone, or other personal digital assistant, and upon connection, the local communications device can transmit the alarm or event information to the portable device.

In some embodiments, the local communications device can include a bell box associated with the alarm system. For example, the bell box can be located in a high, inaccessible position external to the monitored region, for example, outside of the building. Accordingly, the bell box can be ideally located for communication via a low power localized line of sight RF and/or optical communication channel.

In some embodiments, the bell box can include a transceiver circuit, for example, an RS485 transceiver circuit, that can connect and communicate with the alarm system control panel via a cable and/or a communication bus, for example, an RS485 serial data communication bus. In some embodiments, the transceiver circuit can include control circuitry, one or more programmable processors, and executable control software as would be understood by one of ordinary skill in the art. The executable control software can be stored on a transitory or non-transitory computer readable medium, including, but not limited to local computer memory, RAM, optical storage media, magnetic storage media, flash memory, and the like.

In some embodiments, the bell box can act as a communication link between the alarm system control panel and the portable device, such as the smart phone, mobile phone, or other personal digital assistant, and can transmit information, including digital image files and other data, to the portable device. Accordingly, in some embodiments, the bell box can include a communication interface, such as a low power localized RF interface or an alternative interface, such as a Bluetooth or Zigbee interface or the optical, light, and IR signaling interface.

In some embodiments, systems and methods disclosed herein can communicate via visible light communication (VLC) within the monitored region. For example, in some embodiments, building illumination systems, including light emitting diodes (LED), can provide continuous updates regarding the alarm system, including subsequent alarms or other events, updated images or video data streams, and/or text or audio communication from operators at a central station in communication with the alarm system.

In some embodiments, the emergency services personnel can both receive and transmit communications to and from the alarm system and systems and methods disclosed herein via, for example, the portable device. In these embodiments, systems and methods disclosed herein can authorize or authenticate the portable device to communicate with the alarm system before the alarm system accepts communication from the portable device. For example, in some embodiments, once authorized, the emergency services personnel can transmit a command to the alarm system, for example, to silence sounders within the monitored region. Such a command can facilitate the emergency services personnel more easily locating individuals within the monitored region, including intruders within the monitored region.

FIG. 1 is a flow diagram of a method 100 in accordance with disclosed embodiments. As seen in FIG. 1, the method 100 can include the alarm system in the monitored region operating in an armed state as in 110. When an alarm event occurs within the monitored region as in 120, for example, when a sensor in the monitored region is triggered, the occurrence of the alarm event can be communicated to the emergency services personnel as in 130 to dispatch the emergency-services personnel to the site of the monitored region.

The emergency services personnel can be dispatched to the site of the monitored region, and upon arrival as in 140, the emergency services personnel can communicate with the alarm system via a local communications link as in 150. Upon receiving communication from the alarm system, the emergency services personnel can review information received from the alarm system as in 160, which can include information regarding the alarm system, the alarm event, and the monitored region, and the emergency services personnel can respond to the alarm system with a response tailored to the conditions of the alarm system and the monitored region as in 170.

Figure 2:
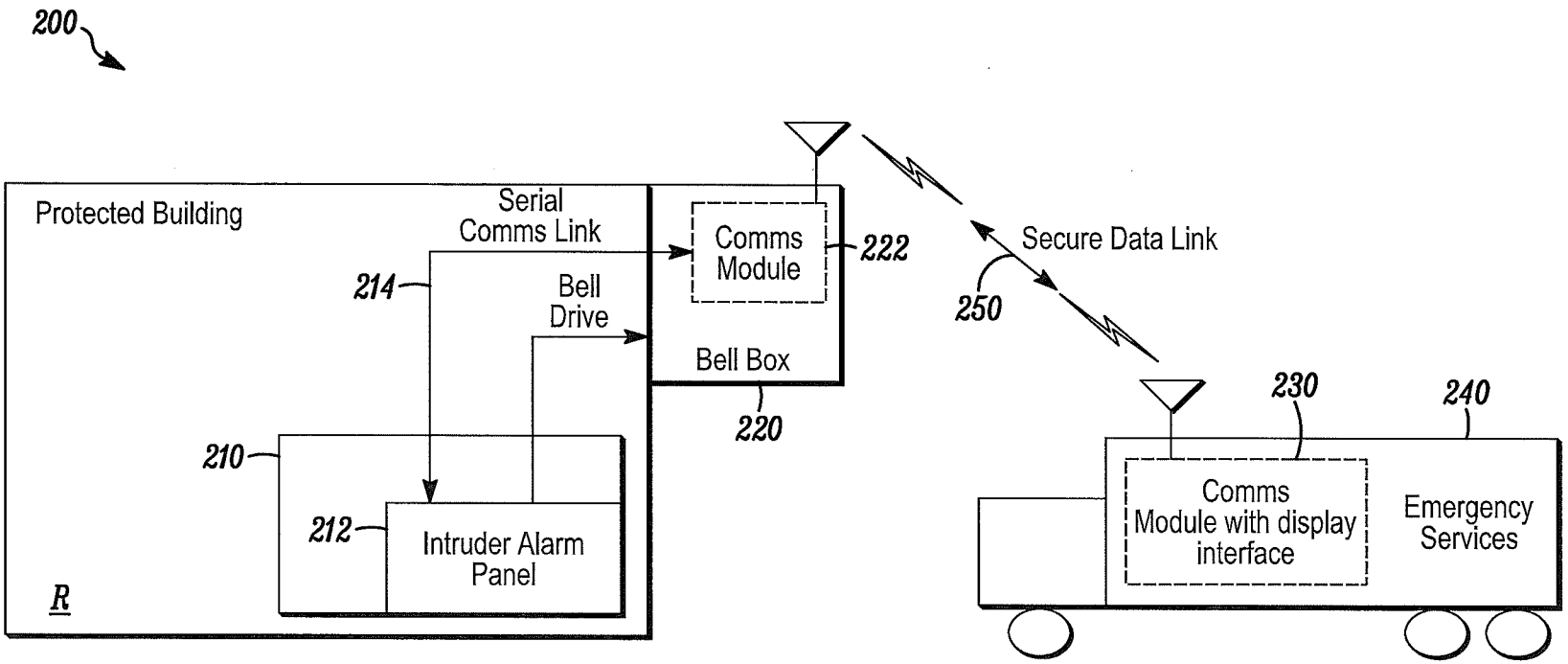
FIG. 2 is a block diagram of a system in accordance with disclosed embodiments.

FIG. 2 is a block diagram of a system 200 in accordance with disclosed embodiments. In some embodiments, the system 200 can execute the method 100 of FIG. 1 and others in accordance with disclosed embodiments.

As seen in FIG. 2, the system 200 can include a monitoring system 210, for example, an intrusion alarm system, in a monitored region R. The monitoring system 210 can include a control panel 212, for example, an alarm control panel, that can communicate with a communications device 220, for example, the bell box. In some embodiments, the control panel 212 can be in bidirectional communication with the communications device 220 via at least a serial communications link 214.

The communications device 220 can include a first communications module 222, for example, a transceiver, which can communicate with a second communications module 230, for example, a transceiver, that is in or associated with a device with a user interface, such as a computer, tablet, or other portable device, including the smart phone, mobile phone, or other personal digital assistant. Some or all of the control panel 212 and the communications modules 222, 230 can include control circuitry, one or more programmable processors, and executable control software as explained above for executing and controlling at least some of the method 100 and others in accordance with disclosed embodiments.

In some embodiments, the second communications module 230 can be associated with the emergency services personnel. For example, the second communications module 230 can be associated with the portable device carried by the emergency services personnel and/or be located in an emergency services personnel vehicle 240, for example, an ambulance or fire truck.

In some embodiments, the first communications module 222 can communicate with the second communications module 230 via a secure data link 250. For example, in some embodiments, the first communications module 222 can transmit information related to the monitoring system 210, the status thereof, and events detected in the monitored region R to the second communications module 230 via the secure data link 250.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the sprit and scope of the invention.

What is claimed is:

1. A method comprising:

providing a transceiver;

the transceiver receiving information from a monitoring system in a monitored region via a first communications link, the information regarding a detected event in the monitored region;

the transceiver communicating an occurrence of the detected event to a third party to dispatch the third party to the monitored region;

when a third party communications module is within a predetermined distance of the monitored region, the transceiver transmitting the information to the third party communications module via a second communications link;

the transceiver receiving a command from the third party communications module via the second communications link; and the transceiver sending the command to the monitoring system via the first communications link, wherein the command silences sounders within the monitored region.

2. The method of claim 1 wherein the second communications link includes a radio frequency communications link.

3. The method of claim 1 wherein the second communications link includes an optical, light, or infrared signaling interface.

4. The method of claim 1 wherein the second communications link includes a secure data link.

5. The method of claim 1 wherein the information includes real-time data.

6. The method of claim 1 wherein the information includes pre-stored data.

7. The method of claim 1 wherein the information includes an image of the monitored region.

8. The method of claim 1 wherein the information includes a video data stream of the monitored region.

9. The method of claim 1 further comprising, upon the occurrence of the detected event in the monitored region, receiving the information from the monitoring system.

10. The method of claim 1 further comprising authenticating the third party communications module prior to transmitting the information to the third party communications module.

11. A system comprising:

a transceiver, wherein the transceiver includes a programmable processor and executable control software stored on a non-transitory computer readable medium for:

receiving information from a monitoring system in a monitored region via a first communications link, the information regarding a detected event in the monitored region;

communicating an occurrence of the detected event to a third party to dispatch the third party to the monitored region;

when a third party communications module is within a predetermined distance of the monitored region, transmitting the information to the third party communications module via a second communications link;

receiving a command from the third party communications module via the second communications link; and sending the command to the monitoring system via the first communications link, wherein the command silences sounders within the monitored region.

12. The system of claim 11 wherein the monitoring system includes at least one of an intrusion alarm system, an ambient condition detection system, and an access control system.

13. The system of claim 11 wherein the first communications link includes a serial data communications bus.

14. The system of claim 11 wherein the second communications link includes at least one of a radio frequency communications link or an optical, light, or infrared signaling interface.

15. The system of claim 11 wherein the third party communications module is housed within a computer, a tablet, a portable device, a smart phone, a mobile phone, or a personal digital assistant.

16. The system of claim 11 wherein the programmable processor and the executable control software authenticate the third party communications module prior to transmitting the information to the third party communications module.

17. A system comprising:

a monitoring system in a monitored region; and a first communications module in communication with the monitoring system via a first communications link, wherein, upon detection of an event in the monitored region, the monitoring system transmits information regarding the event to the first communications module, and wherein, upon receiving the information, the first communications module communicates an occurrence of the event to a third party to dispatch the third party to the monitored region, wherein, upon determining that a third party communications module is within a predetermined distance of the monitored region, the first communications module transmits the information to the third party communications module via a second communications link, wherein the first communications module receives a command from the third party communications module via the second communications link, wherein the first communications module sends the command to the monitoring system via the first communications link, and wherein the command silences sounders within the monitored region.

* * * * *